United States Patent [19]

Hayahusa et al.

[11] 4,050,229

[45] Sept. 27, 1977

[54] FRICTION TYPE YARN FALSE TWISTING APPARATUS

[75] Inventors: Nobuyuki Hayahusa; Hiroaki Uno, both of Numazu, Japan

[73] Assignee: Toshiba Kikai Kabushiki Kaisha, Tokyo, Japan

[21] Appl. No.: 693,329

[22] Filed: June 7, 1976

[30] Foreign Application Priority Data

June 10, 1975 Japan ..... 50-70496
July 28, 1975 Japan ..... 50-91714

[51] Int. Cl.[2] ..... D02G 1/08
[52] U.S. Cl. ..... 57/77.4
[58] Field of Search ..... 57/77.4, 77.42

[56] References Cited

U.S. PATENT DOCUMENTS 2,923,121 2/1960 Tully ..... 57/77.4
3,327,463 6/1967 Nuna et al. ..... 57/77.4
3,901,011 8/1975 Schuster ..... 57/77.4

*Primary Examiner*—Jerry W. Myracle
*Assistant Examiner*—Charles Gorenstein
*Attorney, Agent, or Firm*—Spensley, Horn and Lubitz

[57] ABSTRACT

The apparatus comprises at least two spaced parallel discs having a relatively small thickness and mounted on one rotary shaft, and an intermediate disc having a relatively large thickness and mounted on the other shaft between the discs of small thickness. The two shafts are spaced from each other and the discs having small and large thicknesses have diameters such that the peripheral portions of the discs overlap one upon the other to form intersections therebetween on the rear and front sides. The yarn to be twisted is threaded through an intersection on the rear side, about the periphery of the intermediate disc and then through an intersection on the front side.

7 Claims, 14 Drawing Figures

FRICTION TYPE YARN FALSE TWISTING APPARATUS

BACKGROUND OF THE INVENTION

This invention relates to fiber yarn twisting apparatus for preparing curled yarns, and more particularly to friction type yarn false twisting apparatus for applying false twists to a continuous synthetic yarn by contacting the yarn against the periphery of one or more rotating discs.

As shown in FIGS. 1 and 2, a prior art yarn false twisting apparatus comprises a first pair of friction discs 1, 3 and 5, and a second pair of friction discs 2, 4 and 6 which are mounted on spaced parallel shafts 7 and 8 respectively, the discs of the first and second pairs interleaving with each other. A yarn Y to be twisted is threaded such that it firstly passes through the interactions of the peripheries of the discs 1, 2 and 3 on one side of the assembly and then through the intersections of the peripheries of the discs 4, 5 and 6 on the opposite side. The discs are rotated in the direction of arrows so that the yarn is twisted several times by the friction between it and the discs. For this reason, at least the periphery of each disc is made of or covered by highly frictional material.

Although the friction type yarn false twisting apparatus described above is advantageous in that its construction is simple and the threading operation of the yarn is also easy, as the number of twists increases, the twisting of the yarn becomes unstable and nonuniform. Furthermore, twisting back or untwisting is not performed satisfactory due to stick slip phenomena of the yarn on the discs. Such unstable conditions becomes remarkable as the speed of the yarn increases. Although unstable conditions can be removed by increasing the tension of the yarn, fluffing of the yarn, degradation of the quality of the yarn due to fatigue caused by twisting, and decrease in the life of the periphery of the discs would be resulted.

These difficulties are caused by a large frictional resistance of the disc causing balooning of the yarn. More particularly, when a yarn Y moves from one intersection of the peripheries of the discs to the other, it engages obliquelly against discs 3 and 4. At disc 4, the angle $\alpha_1$ between the direction of advance of the yarn Y and the direction of rotation of the disc is smaller than 90° so that the frictional force F caused by the rotation of disc 4 imparts a component $F_1 = F \cos \alpha_1$ to the yarn in the direction of advance thereof. However, at the other disc 3 since angle $\alpha_2$ is larger than 90°, the yarn will be imparted with a component $F_2$ which is equal to component $F_1$ but acting in the opposite direction. For this reason, with such apparatus, any yarn feeding or advancing action is not produced but the frictional resistance increases whereby the ratio between twisting tension and untwisting tension increases. Consequently, it is difficult to obtain an adequate twisting tension thus making unstable the twisting action of the yarn.

Although it has been proposed to cause a yarn to obliquely engage a disc so as to create a yarn feeding force, such proposal is not satisfactory in that it is impossible to obtain sufficient frictional force thus resulting in an insufficient number of the twists and that it is necessary to provide suitable guides on the front and rear sides of the discs so as to cause the yarn to obliquely engage the disc. However, such guides manifest resistance to the twisting action thus resulting in an insufficient number of twists.

To obviate these difficulties it has also been proposed to substitute discs 3 and 4 which are adjacent each other by discs 3a and 4a as shown in FIG. 1A. Discs 3a and 4a haver a little larger thickness than other discs 1, 2, 5 and 6 and their peripheries are generally conical and curved outwardly. Although this improvement can substantially eliminate the difficulties of the apparatus shown in FIG. 1, it was found that the path of travel of the yarn between discs 3a and 4a varies frequently between the states shown in FIGS. 1B and 1C. When twisting a nylon yarn the number of twists is not sufficient under the state shown in FIG. 1C whereas when twisting a polyester yarn the tension of the yarn varies greatly under the state shown in FIG. 1B. Under the state shown in FIG. 1C when the speed of the yarn exceeds 300 m/min. stick slip occurs on disc 4a resulting in insufficient twisting back.

SUMMARY OF THE INVENTION

It is a object of this invention to provide improved friction type yarn false twisting apparatus having simple construction and in which a yarn to be twisted can be readily threaded through the apparatus.

Another object of this invention is to provide improved friction type yarn false twisting apparatus capable of stably running the yarn with a small resistance thus twisting the yarn stably and uniformly thereby producing false twisted yarns of high quality.

Still another object of this invention is to provide a novel friction type yarn false twisting apparatus employing twisting discs capable of decreasing the resistance to the running yarn and operating for a longer period.

According to this invention, there is provided friction type yarn false twisting apparatus comprising two parallel spaced rotary shafts, at least two parallel spaced discs having a relatively small thickness and mounted on one shaft, an intermediate disc having a relatively large thickness and mounted on the other shaft between the discs of small thickness, the two shafts being spaced each other and the discs of small and large thicknesses having diameters such that the peripheral portions of respective discs overlap one upon the other to form intersections therebetween on the rear and front sides so that the yarn to be twisted can be threaded through an intersection on the rear side, about the periphery of the intermediate disc and then through an intersection on the front side.

DESCRIPTION OF THE PREFERRED EMBODIMENTS

Figure 3:
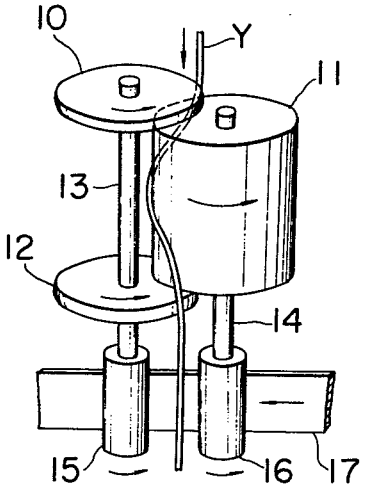
FIG. 3 is a perspective side view showing one embodiment of this invention.
Figure 4:
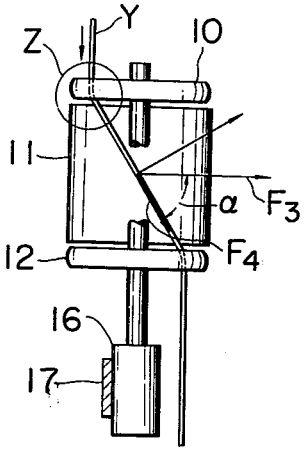
FIG. 4 is a side view of the apparatus shown in FIG. 3 as viewed from right.

In the embodiment shown in FIGS. 3 and 4, two spaced parallel discs 10 and 12 are mounted on a vertical shaft 13 and a disc or a short cylinder 14 is mounted on a shaft 14 parallel with shaft 13 to lie between discs 10 and 12. The distance between shafts 13 and 11 is made smaller than the diameters of discs 10, 11 and 12 so that these discs partially overlap with each other. As will be discussed later in more detail, all or at least the peripheral portions of these discs are made of highly frictional substance such as a polyurethane rubber. The thickness of the intermediate disc 11 is made to be substantially larger than that of the outer discs to take the form of a short cylinder. However, for the sake of description the intermediate short cylinder is also termed herein a disc. Shafts 13 and 14 are driven in the direction of arrows by a belt 17 through pulleys 15 and 16, respectively.

A yarn Y to be false twisted is threaded through the apparatus in the following manner. Thus, as shown in FIG. 3, the yarn is firstly brought to the intersection between the peripheries of discs 10 and 11 on the rear side thereof, then to the intersection between the peripheries of discs 10 and 12 on the front side about the periphery of disc 11, and finally to a feed roller, not shown. Discs are proportioned such that the angle $\alpha$ between the direction of advance of the yarn Y and the direction of rotation of the disc 11 is smaller than 90° as best shown in FIG. 4.

The apparatus shown in FIGS. 3 and 4 operates as follows. When the yarn is threaded as above described and advanced toward lower under a suitable tension, and when the discs are rotated twisting force is applied to the yarn by the engagement thereof with the peripheries of the discs. Since a suitable tension is applied to the yarn, it will be maintained at the intersections on the rear and front sides of the disc as shown in FIGS. 3 and 4. If the axial length of disc or short cylinder 11 is not sufficient the yarn would not pass around it thus making it difficult to assure satisfactory threading. Good result was obtained when the axial length is made to be 10 mm or more for the spacing between shafts 13 and 14 of 40 mm, the diameter of discs of 10, 11 and 12 of 46 mm, and the thickness of the discs 10 and 12 of 5 mm.

Figure 5:
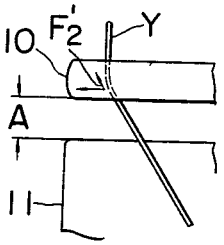
FIGS. 5 and 6 are enlarged partial views of portion Z shown in FIG. 4 showing different constructions.

As has been described above, since angle $\alpha$ between the direction of advance of the yarn Y and the direction of rotation of disc 11 is smaller than 90°, the component $F_4$ in the direction of advance of the yarn of the frictional force $F_3$ created by the rotation of the disc functions to assist the advancement of the yarn. Between the upper disc 10 and the intermediate disc 11, the yarn advances obliquelly with reference to disc 11 and at this portion the yarn is subjected to a component $F'_2$ acting in the direction opposite to the direction of advance of the fiber, as shown in FIG. 5. However, since the thickness of disc 10 is substantially smaller than that of the intermediate disc 11 component $F'_2$ is considerably smaller than component $F_4$. Consequently, according to the twisting apparatus of this invention, it is possible to more positively advance the yarn thereby greatly reducing the frictional resistance in the direction of advance of the yarn. As the yarn is inparted with a very large twisting force by the disc having a large axial length together with the twisting forces applied by the discs 10 and 12 on both sides of the disc 11, the efficiency of twisting is greatly improved. Of course, the twisting force increases with the axial length of the intermediate disc 11, too large thickness results in stick slipping, thus causing unstable running of the yarn so that in the construction described above, it is advantageous to limit the axial length of the intermediate disc to be below 150 mm.

Figure 6:
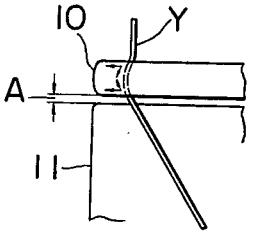

If the distance A between the intermediate disc 11 and the discs 10 and 12 on both sides thereof is reduced extremely as shown in FIG. 6, the yarn Y will partially engage discs 10 and 12 obliquely so that most of the frictional force will be utilized as the twisting force whereby the twisting efficiency can be improved further. Moreover, the yarn engages the disc 10 in such a manner that the forces tending to prevent and enhance the advancement of the fiber cancel each other on the upper and lower half portions of the disc thereby decreasing the force which acts to prevent the advancement of the yarn. For this reason, it is advantageous to select distance A to be smaller than 5 mm.

Where the intermediate disc is made to be globoidal, that is where the diameter at the central portion is larger than that of both ends, the contact pressure exerted to the yarn by the intermediate disc is increased so as to increase the frictional force and hence the twisting efficiency.

Figure 1:
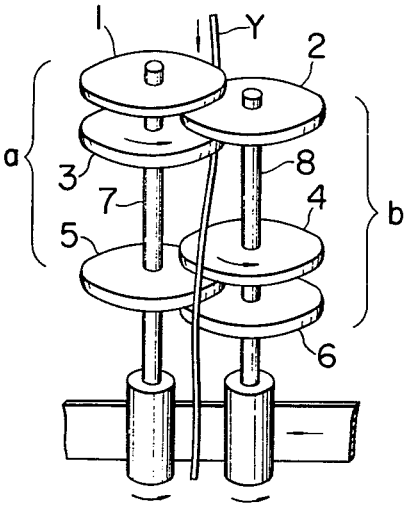
FIG. 1 PRIOR ART
FIG. 1 is a perspective side view showing a prior art false twisting apparatus.
Figure 2:
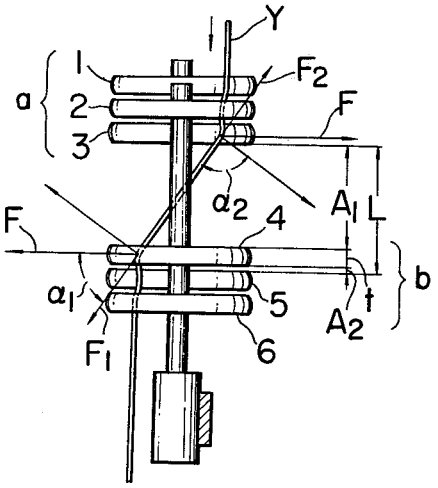
FIG. 2 PRIOR ART
FIG. 2 is a side view of the apparatus shown in FIG. 1 as viewed from right.
Figure 7:
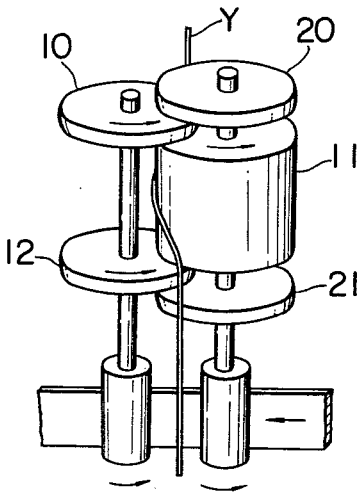
FIGS. 7, 8 and 9 are perspective side views showing another embodiment of this invention.
Figure 9:
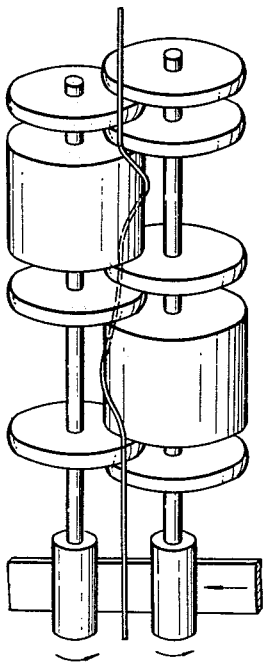
Figure 10:
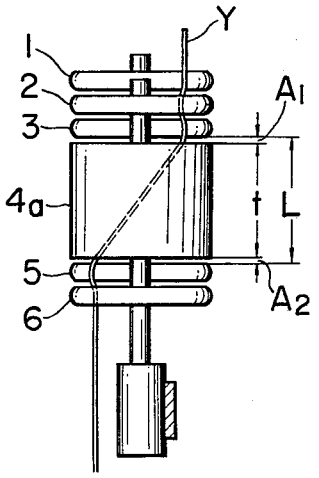
FIG. 10 is a side view of the embodiment shown in FIG. 8 as viewed from right.

In a modified embodiment shown in FIG. 7 additional discs 20 and 21 of a small thickness (preferably equal to that of discs 10 and 12) are provided above and below the discs 10 and 12 respectively so as to partially overlap them. In still another modification shown in FIGS. 8 and 10, the thickness of the intermediate disc 4 shown in FIGS. 1 and 2 is increased as shown by 4*a* to correspond to the intermediate short cylinder 11 shown in FIGS. 3 and 4. In the embodiment shown in FIG. 9, two sets of the apparatus shown in FIGS. 3 and 4 are cascaded in the vertical direction. With these modifications, the number of intersections and or the number of short cylinders are increased so that the twisting force can be increased.

To demonstrate the advantageous effect of this invention, the following experiment was made. In this experiment, apparatus shown in FIGS. 1 and 2 was used as the prior art apparatus, and that shown in FIGS. 8 and 10 as an example of this invention. In both apparatus, the spacings between shafts 7, 8 and between shafts 13, 14 were 40 mm, the diameter of respective disc was 46 mm, and their peripheries were covered by polyurethane rubber. The thickness of various discs except 4*a* was 5 mm, the spacing L between discs 3 and 5, the spacings $A_1$ and $A_2$ between discs 4 or 4*a* and the discs 3 and 5 on both sides thereof, and the thickness *t* of the intermediate disc 4*a* were selected as shown in the following Table I and obtained the result described therein. The yarn used in this experiment comprised a polyester 150 D yarn consisting of 30 filaments. The speed of the yarn was 400 m/min., and the temperature of the heater for heat setting the twisted yarn was 222° C.

Table I

| | | | This invention | |
|---|---|---|---|---|
| | | Prior art | No.1 | No.2 |
| Dimensions | L | 32 | 32 | 32 |

Table I-continued

| | | Prior art | This invention No.1 | This invention No.2 |
|---|---|---|---|---|
| of | t | 5 | 22 | 30 |
| discs | $A_1$ | 26 | 5 | 1 |
| (mm) | $A_2$ | 1 | 5 | 1 |
| Inlet side yarn tension (g) | | 44 | 45 | 50 |
| Outlet side yarn tension (g) | | 114 | 99 | 97 |
| Ratio of tensions | | 2.59 | 2.20 | 1.94 |
| Number of twists(T/M) | | 2520 | 2620 | 2580 |
| Percentage of restoration of elongation | | 37 | 39.5 | 41 |
| Uneven twisting, and unsatisfactory untwisting defects | | Both defects exist | No unsatisfactory untwisting slight uneven twisting | No defect |
| Fluffs | | many | Considerably decreased | extremely decreased |

Figure 1A:
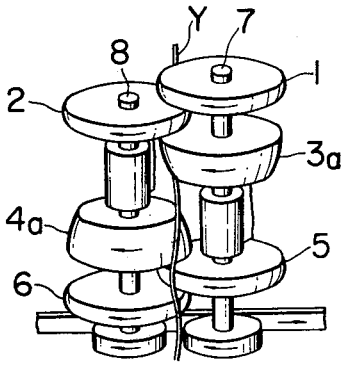
FIG. 1A PRIOR ART
FIG. 1A is a perspective view showing another prior art false twisting apparatus.

The prior art apparatus of this table is that shown in FIG. 1. There were similar defects also in the apparatus shown in FIG. 1A.

Figure 11:
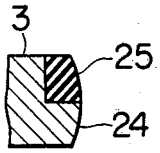
FIG. 11 is a partial sectional view showing a modified disc having a small thickness.
Figure 1B:
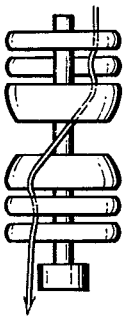
FIG. 1B and 1C are side views of the apparatus shown in FIG. 1A showing different paths of the yarn.
Figure 1C:
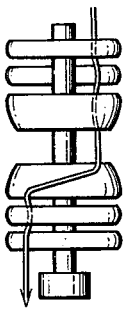

According to another feature of this invention at least a portion of the periphery of the discs adjacent the intermediate disc having a larger thickness is made of a material having a relatively low friction and a high wear resistant property such as ceramic, thermet, metal and a metal alloy. In the example shown in FIG. 11, about one-third to one-half of the thickness of the periphery of a disc 3 positioned above the intermediate disc is made of a material 25 having a high coefficient of friction such as polyurethane rubber, and the remaining portion 24 of the disc 3 is made of a material having a relatively low coefficient of friction and a high wear resistant property. If desired, the entire periphery of the disc 3 may be surrounded by such low friction material. The peripheries of the discs other than disc 3 are made of high friction material. In the embodiments shown in FIGS. 7 and 8, when the entire periphery of the disc 10 or 3 above the intermedient disc is made of ceramic or the like, the periphery of the disc 20 or 2 is also made of ceramic or the like so as to prevent the yarn Y from being pushed toward the front side. When discs as shown in FIG. 11 are used, although the twisting force produced by the low friction material decreases, the contact pressure of the yarn against all discs is decreased due to the decrease in the resistance of the twisting apparatus whereby the contact pressue of the yarn against all discs is made equal thereby assuring uniform twisting operation. In the construction shown in FIG. 11, although the twisting force of the discs provided with low friction material decreases slightly, such decrease can be compensated for the provision of additional discs 20 or 2. The use of the low friction material decreases the wear and increases the life of the disc. Reduction in the wear is effective to prevent uneven twisting thus improving the quality of the false twisted yarn.

The intermediate disc 11 or 4*a* is not required to be wear resistant, so that it can be made of high friction material such as neopren rubber. Although, the wear resistant property of neoprene is slightly lower than that of polyurethane rubber, its friction coefficient is higher.

Figure 8:
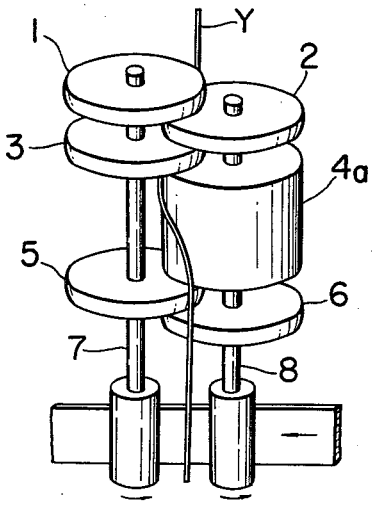

The following Table II shows the result of experiment utilizing apparatus similar to that shown in FIG. 8 in which all discs were made of polyurethane rubber, and one half of the thickness of the peripheries of discs 3 and 5 was plated with hard chromium film. In the prior art apparatus all discs were made of polyurethane rubber. The yarn used in this experiment was polyester DOY 206d/32f (before drawing), yarn speed was 500 m/min., the temperature of the heater for setting the twisted yarn was 210° C and the speed ratio (yarn speed/the peripheral speed of the disc contacting the yarn) was 0.3.

Table II

| | Prior art apparatus | This invention |
|---|---|---|
| Inlet side yarn tension (g) | 52 | 54 |
| Outlet side yarn tension (g) | 62.5 | 58.5 |
| Tension ratio | 1.20 | 1.08 |
| Number of twists | 2460 | 2450 |
| Not untwisted yarn | Slight | no |

In the apparatus shown in FIG. 8, the peripheries of the uppermost disc 1 and the intermediate disc 4*a* were made of high friction material such as polyurethane rubber or neoprene, whereas the peripheries of other discs 2, 3 5 and 6 were covered by films of such wear proof material as ceramic, a plating of chromium and anodically oxidized aluminum. This modification can also decrease the wear of the discs, and increases the life thereof, for example, from 200 hours to 2,000 hours, thus assuring constant number of twists and high quality of the twisted yarn. Although the both ends of the intermediate disc wear slightly, since the purpose of this disc is to apply a feed force to the yarn, slight wear of both ends does not affect the basic operation of the apparatus. Since the required twisting force is provided by all discs and since the resistance against twisting is small a sufficiently large number of twists can be provided. For example, when a yarn of polyster 150d was processed at a speed of 500 m/min., a twist number of 2310 T/M was obtained.

The periphery of the uppermost disc 1 was made of high friction material because the tension of the yarn decreases toward upper and since the contact pressure of the yarn against this disc is relatively small and has a small effect upon the yarn tension. As has been described in connection with FIG. 11 it is not always necessary to make the entire width of the peripheries of discs 2, 3, 5 and 6 of wear resistant material, and only about one half (the side to which the yarn contacts strongly) may be made of such material.

As above described, the false twisting apparatus of this invention can be made up of a minimum of three discs, that is two relatively thin discs and one relatively thick intermediate disc so that the threading of the yarn to be twisted can be made very readily. As the advancing force is mainly provided by the intermediate disc it is possible to decrease the resistance against the running of the yarn. Moreover, the ballooning of the yarn is prevented so that uniform twisting can be applied thus improving the quality of the twisted yarn. The discs having small thickness act as the guides for the yarn and provide additional twisting forces.

The frictional force applied to the running yarn varies in accordance with the coarseness of the surface of the disc. More particularly, it has been considered that when the surface of the disc is mirror finished, the frictional force applied to the yarn increaes. However, in the case of rubber or synthetic rubber described above, even when the surface of the disc is mirror finished considerably high twist number can be obtained due to the high coefficient of friction of rubber, but in the case of ceramic, metal, etc., if the surface thereof is mirror finished only a very low twist number would be obtained due to a low coefficient of friction of the ceramic and metal. We have found that when the frictional surface of the disc is finished to have a coarseness of from 45 to 125, the number of twists can be increased irrespective whether the frictional surface of the disc is made of rubber or ceramic or metal. More particularly, when the frictional surface of the disc is finished to a coarseness of 1.05 which substantially corresponds to a mirror finished surface, a twist number of only 650 T/M is obtained. As the surface coarseness increases to 4.05 the twist number unexpectedly increases to 2150 T/M. Up to a coarseness of 125, substantially the same twist number can be obtained. However, coarseness higher than 125 should be avoided because breakage of the yarn occurs.

We claim:

1. Friction type yarn false twisting apparatus consisting essentially of two parallel spaced apart rotary shafts, means for rotating said shafts in the same direction, at least two relatively thin spaced apart discs mounted on one of said shafts and a relatively thick disc on the other shaft located between said thin discs with axial spaces therebetween so as to slightly overlap with each other to form intersections between the peripheral portions of respective discs at angularly spaced points of the peripheral portions thereof whereby yarn is threaded successively through one of said intersections, diagonally across the peripheral surface of said thick disc and then through the other intersection thereby applying a flase twist to said yarn.

2. Friction twisting apparatus according to claim 1 wherein the angle formed between the direction of advancement of said yarn and the direction of rotation of said thick disc is less than 90°.

3. The apparatus according to claim 1 wherein all of said discs have the same diameter.

4. Friction twisting apparatus according to claim 1 wherein the axial space between one of said thin discs and said thick disc is about 5 mm or less.

5. Friction twisting apparatus according to claim 1 wherein said thick disc is less than 150 mm in axial length.

6. Friction twisting apparatus according to claim 5 wherein each said thin disc is about 5 mm in axial length.

7. The apparatus according to claim 1 which further comprises additional discs of relatively small thickness mounted on said other shaft to partially overlap the discs of relatively small thickness mounted on said one shaft.

* * * * *